US007213287B2

(12) United States Patent
Hui

(10) Patent No.: US 7,213,287 B2
(45) Date of Patent: May 8, 2007

(54) SWIMMING POOL CLEANER

(75) Inventor: Joseph Wing-Tak Hui, Cupertino, CA (US)

(73) Assignee: Smartpool, Inc., Lakewood, NJ (US)

( * ) Notice: Subject to any disclaimer, the term of this patent is extended or adjusted under 35 U.S.C. 154(b) by 572 days.

(21) Appl. No.: 10/345,152

(22) Filed: Jan. 16, 2003

(65) Prior Publication Data

US 2003/0159723 A1 Aug. 28, 2003

Related U.S. Application Data

(60) Provisional application No. 60/349,231, filed on Jan. 18, 2002.

(51) Int. Cl.
*E04H 4/16* (2006.01)

(52) U.S. Cl. ..... 15/1.7; 210/167.16

(58) Field of Classification Search ..... 15/1.7; 210/169, 167.16

See application file for complete search history.

(56) References Cited

U.S. PATENT DOCUMENTS

| | | | | |
|---|---|---|---|---|
| 2,146,021 A | | 2/1939 | Raymond | |
| 2,444,912 A | * | 7/1948 | Bodine, Jr. | 417/53 |
| 2,683,956 A | | 7/1954 | Conte | |
| 2,988,762 A | | 6/1961 | Babcoch | |
| 3,822,754 A | | 7/1974 | Henkin et al. | |
| 3,860,518 A | | 1/1975 | Henricksen | |
| 3,886,616 A | * | 6/1975 | Hayes | 15/1.7 |
| 4,100,641 A | | 7/1978 | Pansini | |
| 4,141,101 A | | 2/1979 | Gibellina | |
| 4,168,557 A | * | 9/1979 | Rasch et al. | 15/1.7 |
| 4,169,484 A | | 10/1979 | Bonigut et al. | |
| 4,429,429 A | | 2/1984 | Altschul | |
| 4,463,520 A | | 8/1984 | Crosman | |
| 4,558,479 A | | 12/1985 | Greskovics et al. | |
| 4,589,986 A | | 5/1986 | Greskovics et al. | |
| 4,920,599 A | | 5/1990 | Rief | |
| 5,099,535 A | | 3/1992 | Chauvier et al. | |
| 5,337,434 A | * | 8/1994 | Erlich | 15/1.7 |
| 5,882,512 A | * | 3/1999 | Denkewicz et al. | 210/169 |

(Continued)

FOREIGN PATENT DOCUMENTS

| | | |
|---|---|---|
| DE | 3110203 | 9/1982 |

(Continued)

OTHER PUBLICATIONS

M. Simoncelli et al, Autonomous Robots, "Autonomous Pool Cleaning: Self Localization and Autonomous Navigation for Cleaning", CAS-Centre of Autonomous Systems, Royal Institute of Technology, 2000, vol. 9, pp. 261-270.

*Primary Examiner*—Gary K. Graham
(74) *Attorney, Agent, or Firm*—Birch, Stewart, Kolasch & Birch, LLP

(57) ABSTRACT

A self-propelled swimming pool cleaner which randomly covers the bottom of the pool. Water pumped from the bottom of the unit filters dirt carried thereby, then uses the pumped water to propel the device either forward or backward. A pivoted front axle causes the path of the unit to vary when changing from forward to backward so that the unit randomly covers the entire pool bottom. Spring loaded doors may be provided to allow water to exit when the unit is lifted out of the pool. A sealed motor unit has a metal portion to transfer heat from the motor.

18 Claims, 5 Drawing Sheets

U.S. PATENT DOCUMENTS

| | | | | |
|---|---|---|---|---|
| 5,974,347 | A | 10/1999 | Nelson | |
| 5,985,156 | A | 11/1999 | Henkin et al. | |
| 6,039,886 | A | 3/2000 | Henkin et al. | |
| 6,187,181 | B1 * | 2/2001 | Stoltz et al. | 210/122 |
| 6,280,611 | B1 | 8/2001 | Henkin et al. | |
| 6,294,084 | B1 | 9/2001 | Henkin et al. | |
| 6,299,699 | B1 | 10/2001 | Porat et al. | |
| 6,412,133 | B1 | 7/2002 | Erlich et al. | |
| 6,473,927 | B1 * | 11/2002 | Sommer | 15/1.7 |
| 6,742,613 | B2 | 6/2004 | Erlich et al. | |
| 2001/0050093 | A1 | 12/2001 | Porat | |
| 2002/0104790 | A1 * | 8/2002 | Lincke | 210/169 |

FOREIGN PATENT DOCUMENTS

| | | | |
|---|---|---|---|
| EP | 0 475 736 | A1 | 3/1992 |
| JP | 54-3376 | | 1/1979 |
| JP | 54-3376-D | | 1/1979 |
| JP | 54-9457-D | | 1/1979 |
| JP | 54-15365 | | 2/1979 |
| JP | 54-45971 | A | 4/1979 |
| JP | 54-45972 | A | 4/1979 |
| JP | 54-50157 | A | 4/1979 |
| JP | 54-50157 | A | 4/1979 |

* cited by examiner

SWIMMING POOL CLEANER

The present application claims priority under 35 U.S.C. § 119 on provisional application 60/349,231, filed Jan. 18, 2002, the entirety of which is hereby incorporated by reference.

FIELD OF THE INVENTION

The present invention is directed generally to a cleaning device for a swimming pool and more particularly, to a device for cleaning the bottom of a swimming pool and which changes direction upon hitting a wall.

DESCRIPTION OF THE BACKGROUND ART

Swimming pools are a convenient source of recreation and exercise for many people. For those fortunate enough to have a private pool at their own residence, the convenience is even greater. However, this facility also requires a great deal of cleaning to keep it free from dirt and bacterial growth. The desirability of the pool decreases greatly if it is dirty or has algae growing. Unfortunately, due to the large size of such a pool and its openness, it is subject to receiving a great deal of dirt and other foreign material which is carried by the wind, dropped by nearby vegetation, or carried into the water by its users.

The foreign material may be left floating on the water, as in the case of leaves, may be dissolved in the water, or may eventually deposit on the floor of the swimming pool. Some dirt may be removed from the water by the action of the filtering pumps which remove the water, filter it, and return it to the pool. Debris which is floating on the surface of the water may be removed using a skimmer, either in the form a long pole with a net on the end, or by an automated system. However, a more difficult situation is removal of material from the floor of the pool. A common way to remove this material is to utilize a suction device which is carried across the floor of the pool. One simple method of doing this is to utilize a long pole carrying a suction head which is connected to a pump by way of a long hose. As water is drawn into the suction head, it picks up the dirt, as long as the head is in close proximity to the floor of the pool. While this is efficient in terms of the control of the location of the head, it requires the physical effort and concentration of an operator.

Other devices can also be used to clean the floor of the pool which do not require the attendance and efforts of an operator. Such devices include typically a wheeled vehicle which travels along the floor and which carries a suction head. The suction head may be connected to a separate vacuum source by way of a hose or may merely use a self-contained filter so that the cleaned water may be returned to the pool. While this type of device does not require the attention and effort of an operator, it is necessary that it be directed to cover the entire area of the pool bottom. One way of doing this is to have some type of programmed pattern so that the pool bottom is completely covered by the cleaning device. However, this type of system is difficult to program because of the varying sizes and shapes of pools. Also, since the device is not intelligent, it is easy to be dislodged from the desired pattern and once dislodged, the entire bottom would not be cleaned.

One manner of avoiding the problem of following a pattern is to allow the device to merely act randomly, so that given sufficient time, the entire floor would be cleaned. This is typically accomplished by allowing the device to proceed along the floor and to reverse direction when it comes into contact with the wall. However, this would require that the course be changed when it is reversed so that it will not merely go back and forth over the same path. One manner of changing the course is to have a switch which is actuated when a bumper or other part of the cleaner comes into contact with the wall. When the wall is contacted, the switch is activated and some mechanism is used to physically move the device or to lift up one side so that a course change is generated from the wheels in contact with the ground. Such a mechanism requires additional power and additional structure in order for it operate. It also has a problem that continued bumping into a straight wall may cause damage to the cleaner. Also, the additional mechanism is subject to maintenance needs and repairs.

Another way of changing the direction of such a cleaner, is to allow the device to continue pushing even when it hits a wall at an angle, so that it becomes square to the wall before reversing. This would change its direction from an angle to the wall to the perpendicular to that wall. However, if the unit initially contacts the wall at a 90° angle, it then merely reverses into the same path, which is not desirable. This would allow the cleaning device to run back and forth in the same path from side-to-side without cleaning the entire floor.

Other problems are also present in such pool cleaners. When the cleaning operation is finished, the cleaning unit should be removed from the pool. However, since it is full of water, it can be quite heavy to lift and further, it is desirable to drain the water from the inside without disturbing the dirt which has been collected. One system which is previously been used is to provide a rubber or elastic vinyl flap on the sides of the cleaner which swing outwardly to allow the water to drain. These flaps would not open when the device is in water, because the pressure on either side would be equalized. However, when the cleaner is removed from the water, any water contained inside would be heavier then the air outside the flap and accordingly the flap would open, allowing the water to drain out. While this system will work, the flaps tend to be deformed after a period of time so that the doors do not seal properly.

Doors are usually provided on the bottom of the device to allow the water which is being suctioned up to easily flow therein. Thus, the doors swing inwardly to allow water to rise from the bottom of the pool into the inside of the unit. When the unit is removed from the water, water could not flow out this door unless it is tilted to the side. This is desirable to prevent captured dirt from being returned to the pool.

Other problems can be involved with such a cleaning system. It is important for the motor which drives the system to be waterproofed and still to allow heat to escape from the motor and other components. In this manner, it is also necessary to have watertight connections with electrical wiring connected to the pump.

SUMMARY OF THE INVENTION

Accordingly, one object of the present invention is to provide a cleaning device for the floor of a swimming pool which effectively changes course upon striking a wall.

Another object of the present invention is to provide a simple and effective apparatus for cleaning the bottom of a swimming pool.

Another object of this invention is to provide a reversal mechanism for a cleaning device.

A still further object of this invention is to provide a cleaning device for the bottom of a swimming pool which has a pivoting axis.

Another object of this invention is to provide a cleaning device for the bottom of a swimming pool which effectively changes course by changing the swivel angle of one axle to thus change the course of movement of the device.

Another object of this invention is to provide a cleaning device for a swimming pool which has spring loaded doors on sides of the device to allow water to escape when not in use.

Another object of this invention is to provide a cleaning device for a swimming pool having spring loaded doors on both the sides and bottom of the device.

A still further object of this invention is to provide an integrated pump and motor assembly for a cleaning device in a swimming pool with a central metal section to remove generated heat.

A still further object of this invention is to provide a water proof strain relief on wires entering the motor assembly by using a strain relief in the form an elastic material having a shape which matches a seat in the chamber body.

Another object of this invention is to provide a cleaning device for the bottom of a swimming pool where water expelled from a pump is directed out of nozzles in the front and back directions in order to move the unit.

A still further object of the invention is to provide a cleaning system for the bottom of the swimming pool having a steering mechanism which causes the system to change course upon hitting a wall and having spring loaded doors to release water contained therein and an integrated motor and pump assembly which directs water out of two nozzles pointing in opposite directions to move the unit.

Briefly, these and other objects of the invention are achieved by providing a wheeled pool cleaner where the front axle can pivot causing the unit to move differently in the front and backward directions automatically merely by reversing the application of the motive power. This is accomplished merely by providing a water jet from one of two oppositely directed nozzles. The cleaner also has spring loaded rigid plastic doors to allow water to escape when the unit is removed from the pool. The integrated motor and pump assembly includes metal sides to allow heat conduction while retaining a watertight environment for the motor.

BRIEF DESCRIPTION OF THE DRAWINGS

A more complete appreciation of the invention and many of the attended advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
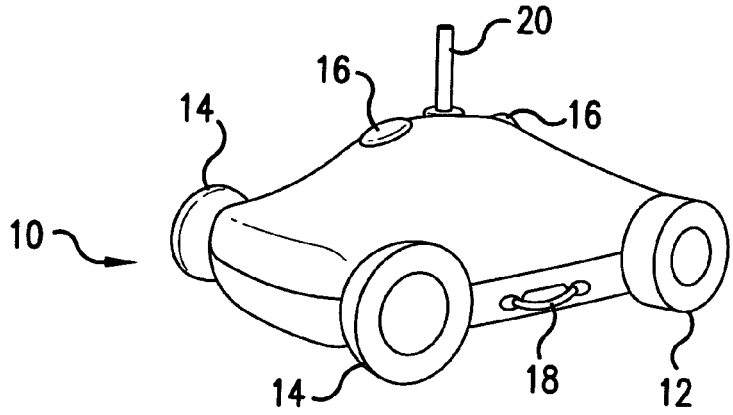
FIG. 1 is a perspective view of the cleaning unit of the present invention.

Referring now to the drawings, wherein like reference numerals designate identical corresponding parts throughout the several views, and more particularly, FIG. 1 thereof, wherein the pool cleaning device is seen as reference numeral 10. The device includes a body which is generally rectangular, having a domed top. The device includes a pair of front wheels 14 and a pair of rear wheels 12. Each pair of wheels is connected to an axle and fixedly connected thereto. Handles 18 are provided on the sides of the device for convenient lifting. Handles are made hollow, to provide buoyancy. Nozzles 16 are directed in opposite directions toward the front and back. These nozzles are utilized for propulsion as will be described later. A power cord 20 enters the device from the top in a watertight connection.

Figure 4:
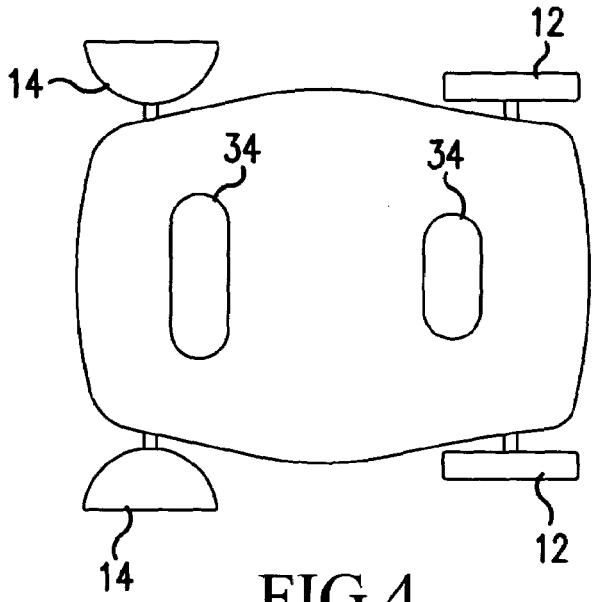
FIG. 4 is a bottom view of the cleaning unit of the present invention.

The power cord is connected to a motor and pump arrangement (not shown) which is arranged inside the device. As the motor turns the pump, water is first sucked up through the bottom of the device through doors 34 (see FIG. 4). A reusable filter bag is arranged inside the housing so that water entering through the doors passes through the filter bag before entering the pump. Thus, the filter bag is arranged between the doors 34 and the pump. The pump ejects water and directs it to one of the two nozzles where it forms a water jet. This jetting action causes the device to move in the opposite direction to the jet.

Figure 2:
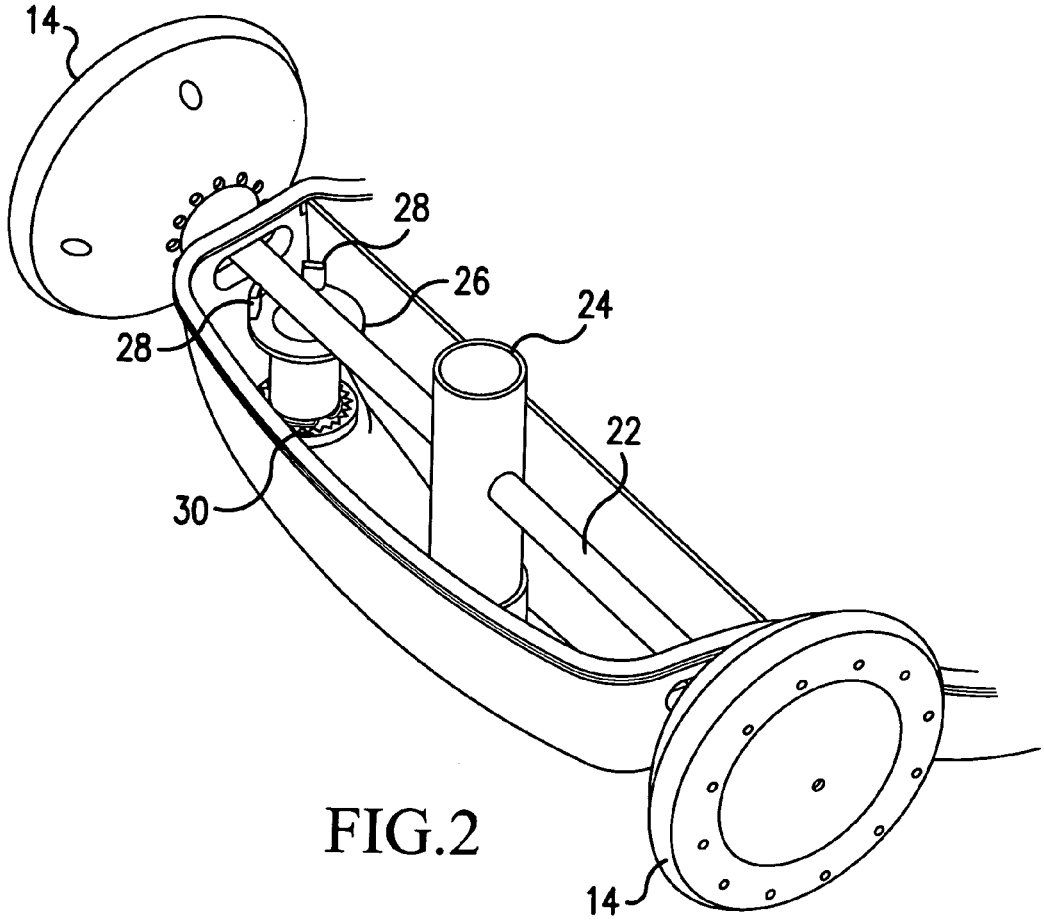
FIG. 2 is a bottom cut away view of the unit showing the front wheels and axle.
Figure 3:
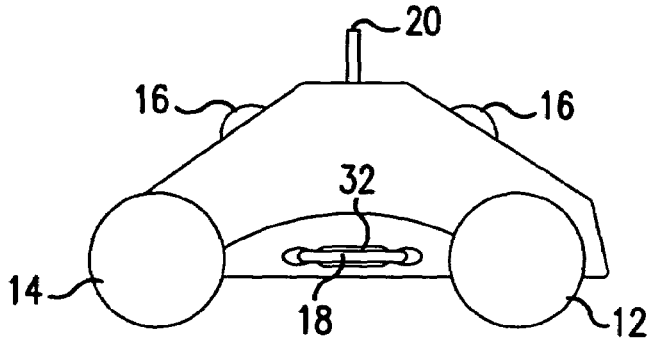
FIG. 3 is a side view of the cleaning unit of the present invention.

As indicated above, it is important that the cleaning device change direction at least slightly when it impacts a wall of the pool so that it does not track the same path over and over. In the present device, this is accomplished by having at least one of the axles swivel about a pivot. As seen in FIG. 2, wheels 14 are fixedly connected to axle 22. This axle is mounted on pivot 24 which allows the axle to move forward and backward. However, the amount of forward and backward movement is limited by a rotating fork 26 having two projections 28, with one on either side of the axle. When the axle pivots, it is limited in the amount of pivoting by the projections. The projections are spaced from each other by an amount to allow sufficient pivoting so that different paths of motion can occur. Preferably, the rotating fork is adjustable by turning it along its axis. This gives a selection of positions and hence a selection of movements of the cleaning device. Ratchet device 30 is mounted on the rotating fork so as to provide a plurality of distinct positions of the fork. For example, three positions may be possible, a first where the projections are centered along the line perpendicular to the direction of movement, a second where the projections are centered forward to this line, and a third, where the projections are centered behind this line. In the first instance, the axle may pivot in a range from slightly clockwise of the center of position to slightly counterclockwise. In the other two positions, the axle will swing by the same amount, but centered on a different position. By having three different positions, the pattern that the cleaner follows may be varied since different patterns may be more effective for different size and shape pools. Since the power cable is connected to the transformer, which is stationary while the cleaner moves around in the pool. When the cleaner reverse to the left, it will twist the power cable clockwise. When the cleaner is reverse to the right, it will twist the power cable anticlockwise. The device not only allows convenient cleaning pattern adjustment, but also simple and easy unwinding the power cable automatically while the cleaner is cleaning the pool.

In the example shown in FIG. 2, the pivot point 24 is centered. This may be placed off center if desired. Also, wheels 14 are shown as having a cup or dome shape on the inside part of the wheel, rather than having a solid disc. This shape allows the wheel to turn more freely so that the inner edge does not rub against the side of the body when the axle pivots. While this shape is preferable, other shapes, including traditional disc shapes could be used. The wheels are fixed solidly to the axle so that both wheels must turn together. The rear wheels 12 may be traditional disc shaped wheels with a fixed axle or may also pivot in the same manner.

The provision of the front wheel being cup-shaped has an additional benefit in that this provides a narrow surface in contact with the ground which makes the steering more sensitive. This helps to enhance the pivoting action of the axle. The wheel may also have a spacer or other mechanism to prevent it from touching the body and to prevent any movement of the wheel along the axle. Thus, the wheel is fixed to the axle both in its rotation and along its axis.

It is also possible to use a different mechanism then the rotating fork to control the position of the swivel. For example, another mechanism could be a sleeve having an oval shape in cross section which fits over the axle and allows the axle to move back and forth within the sleeve. The sleeve would be fixed for a given position but could occupy three or more positions just as the rotating fork.

The concept of the pivoting axle is very simple. When the unit is being moved forwardly, the axle will assume a certain position. However, it has been found that when the unit reverses direction, the axle will also pivot, if allowed to do so. This pivoting action of the axle causes the device to follow a different path when the device is reversed. This has been found to be true even if the surface on which the wheels are placed is uniform and level. Since the axle pivots when the direction is reversed, the unit will take a different path every time the direction is reversed, and as a result, a completely random pattern will be generated so that the entire pool bottom will be covered by this random movement. This arrangement allows the entire pool to be cleaned without intervention by the operator and without any complicated mechanical parts. It also does not require the use of additional power to change the direction of the device.

As described above, when the pump is operational, water is sucked through holes 34 in the bottom of the unit. The water is then ejected through one of the jets 16 on the top of the unit. However, when the cleaning operation is finished, it is necessary to remove the unit from the pool. Since the inside of the body will be filled with water, the device will be quite heavy when moved above the surface of the water. It is therefore necessary to allow the water to escape at this time.

Doors 34 are hinged so as to move inwardly and allow water to easily move up into the inside of the body of the unit. Thus, when the unit is removed from the water, the trapped water inside the body will not flow back through this door and in fact will act as a check valve because the weight of the water will force the door back into its seat to prevent water from escaping. This is actually desirable because the water at this location is on the inside of the filter and any water escaping from this direction would carry the dirt and debris back out into the pool. It is instead desirable to have a different egress for the trapped water. Doors 32 are provided on the sides or other location of the body outside the filter. In a preferred arrangement, the doors are actually placed directly under the handles 18 so that the hinge arrangement of the doors can be mounted on the structure that holds the handle. However, the doors 32 could be placed at any location of the body as long as it is arranged on the downstream side of the filter. More than one such door can be provided and preferably one is placed on opposite sides of the unit near each handle. While these doors have previously been made of soft material, they tend to deform with age. In the present device, these doors are made of relatively hard material and are hinged to swing outwardly. The doors are spring loaded so as to help keep them closed and in firm contact with the seat. This prevents the door from warping, and thus prevents deterioration with age.

When the unit is removed from the water, the weight of the water inside the unit will force the doors 32 open against the action of the spring. This does not occur when the unit is below the water surface because the weight of the water inside the unit is balanced by the water pressure from outside. When the pump is turned on, the water chamber will create a partial vacuum, that sucks and close the two side doors. However, as soon as the unit is lifted above the surface, the water inside will force the doors open against the action of the spring and the water will escape.

It would also be possible to add springs to doors 34 on the bottom of the unit. This would aid the doors in remaining shut when the unit is lifted out of the water. This would be desirable so that if the unit is tilted when lifted the doors would remain shut and not allow water to escape from this door. Such an escape would be undesirable since it would likely carry dirt and debris with it as described above. However, the presence of the spring would act against the suction action of the pump trying to pull water in from the bottom of the unit. Thus, the strength of the spring must be fairly small or it will interfere with the suction action.

Figure 5:
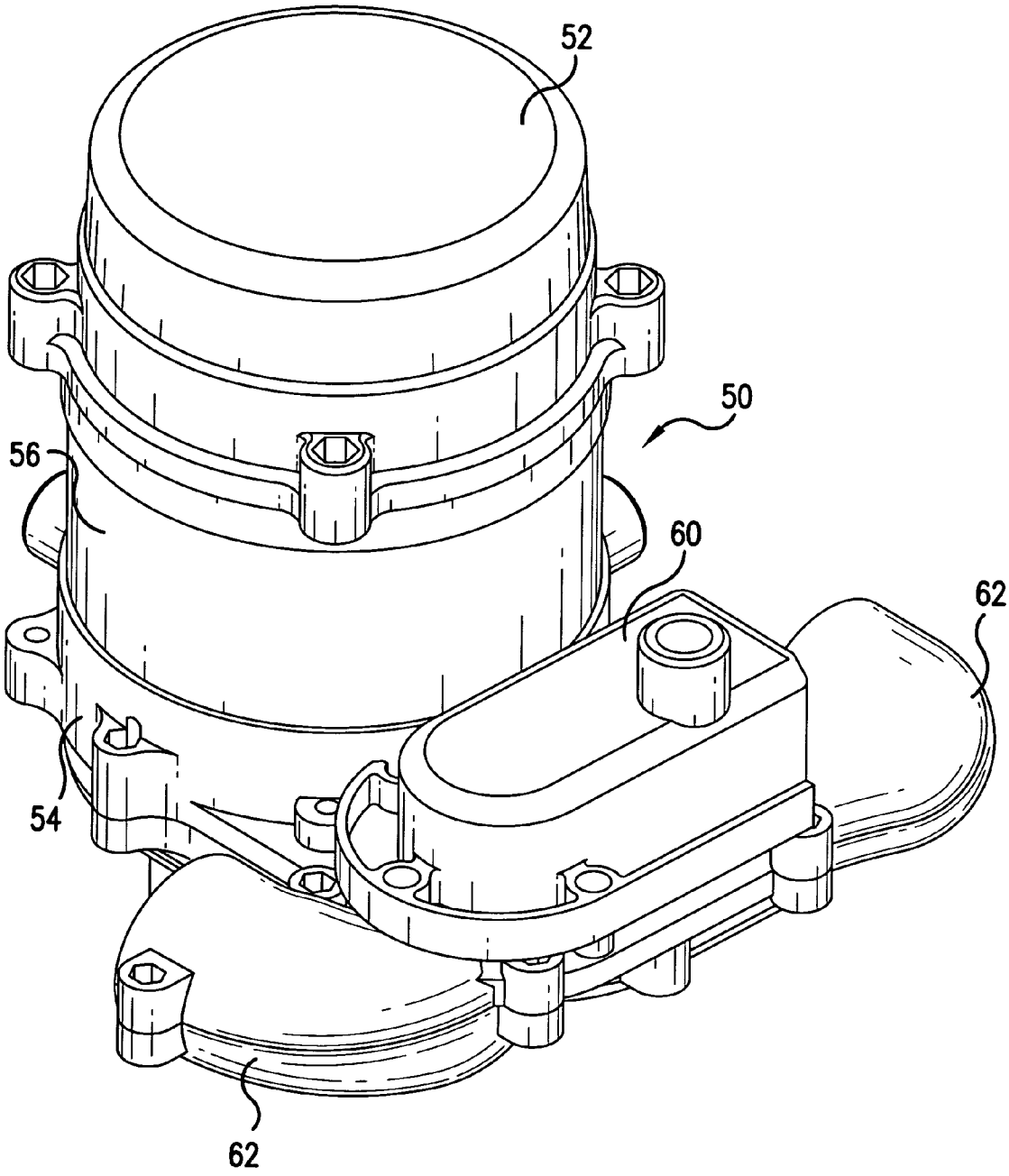
FIG. 5 is a perspective view of the motor and pump assembly of the present invention.

FIG. 5 shows the motor and pump assembly 50 which is mounted inside the body of the cleaning unit. The assembly is actually shown in the inverted position and would normally be placed upside down so that horns 62 align with nozzle 16. Thus the bottom part of the assembly 52 would actually face the bottom of the unit. This assembly is mounted using bolts or similar fasteners so that it hangs down from the top of the body inside the unit.

The assembly 50 includes a motor, control PCB and pump (not seen). The housing which contains the motor and pump includes three parts, a bottom plastic piece 52, a top plastic piece 54, and a central metal piece 56. Within the assembly there is a wall dividing the motor from the pump with the three exterior parts and this wall forming a hermetically sealed unit which contains the motor. This compartment contains the motor and is also filled with a non-conductive oil for transferring heat from the motor to the housing. The metal central portion of the housing is designed to remove the heat from the oil and transfer it to the outside. Since the unit is normally filled with water when operating, the water from the swimming pool carries the heat away from the metal portion.

The movement of the shaft of the motor spinning inside the chamber helps to circulate the dielectric liquid throughout the chamber and therefore helps the heat transfer through the metal section. The liquid contained in the chamber helps to prevent water leaks by providing a better pressure balance than if it was filled with air.

The motor includes a shaft which extends through the dividing wall and is connected to an impeller of the pump. The pump part of the assembly is not hermetically sealed since it must be in contact with the pool water to operate.

The pool water may enter the impeller from the central portion of the top of the assembly. It is desirable to place the pump inlet as close to the top of the unit as possible, to minimize air trapped inside the unit. If any air left and trapped, it can easily be displaced. This location is preferable since it is farthest from the doors 34 where the water enters the unit and accordingly is less likely to ingest debris. Also, this point is centrally located causing the suction to be as uniform as possible. Alternatively, the entrance to the pump could be at any point in the top portions of the housing and could even be in more than one location. The exit for the pump is below the diverter valve assembly 60. This exit port is connected to horns 62 by a diverter valve assembly 60. This assembly includes a solenoid which drives the valve to one of two locations so that only one of the two horns is connected to the pump exit port at a time. The circuit board for controlling the operation of the motor and solenoid is preferably contained within the chamber for the motor to prevent any possible contact with the pool water. It would also be possible for the solenoid to actually be contained within the same chamber and be connected to the diverter valve through a mechanical connection which is sealed.

In operation, the motor is connected to a source of electrical power and to a controller on the circuit board. Upon a command from the circuit board controller, the motor is turned on, driving the impeller of the pump and causing water to be sucked into the pump and driven out through one of the two horns. The particular direction is chosen by the controller and determined by the position of the diverter valve. When the controller determines that the unit has stopped moving, a signal is sent to the solenoid to change the position of the diverter valve so that the expelled water is driven out the opposite horn and nozzle to reverse the direction of the device. The solenoid used for the diverter valve can be a single solenoid with a spring loaded return, a double solenoid, a servomotor, or any other electromechanical device which could assume two different positions.

Figure 6:
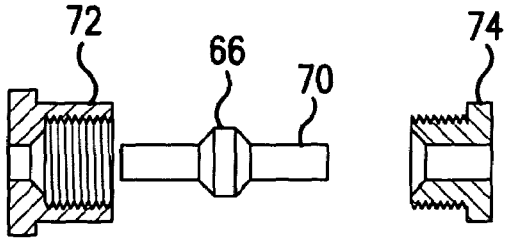
FIG. 6 is a view of the strain relief arrangement used in the present invention.

FIG. 6 shows an arrangement to provide a water proof connection through wires entering the motor chamber. A strain relief device 66 is mounted on wire 70. This strain relief device is made of elastic material and preferably the same type of material as the exterior of the wire so that it bonds easily. The diverter device has a shape which corresponds to the seat provided on the wall of the chamber 72. Threads are provided on the internal part of this seat arrangement and the strain relief device is placed therein in solid contact with the seat. A nut 74 having exterior threads is placed within the same device and forms a seat on the other side of the strain relief device. The thread is tightened into the body arrangement so that the strain relief device is firmly seated against both sides, thus forming a water proof connection and also a strain relief device at the same time.

In controlling the movement of unit, it is necessary to determine when the unit stops moving, such as when it comes into contact with the wall. The present invention determines this in a simple fashion by placing a well known reed switch arrangement within one or more wheels of the device, preferably one of the rear wheels 12. The reed switch is mounted on a fixed portion of the housing or wheel assembly and one or more magnetic devices are placed on the moving part of the wheel in close proximity to the reed switch so that as the wheel turns, each magnet causes the reed switch to close as it passes thereby. Thus, the reed switch will close a circuit once for each wheel rotation for each magnet. Thus, if two magnets are provided on the wheel two circuit closings will occur for each rotation. If such switches are provided on more than one wheel, either one of the wheel stops sending signal out indicates the unit is either hitting the wall at an angle, or the unit gets hang up on one side. It may also be possible to utilize the different signals to provide other indicators.

Figure 7:
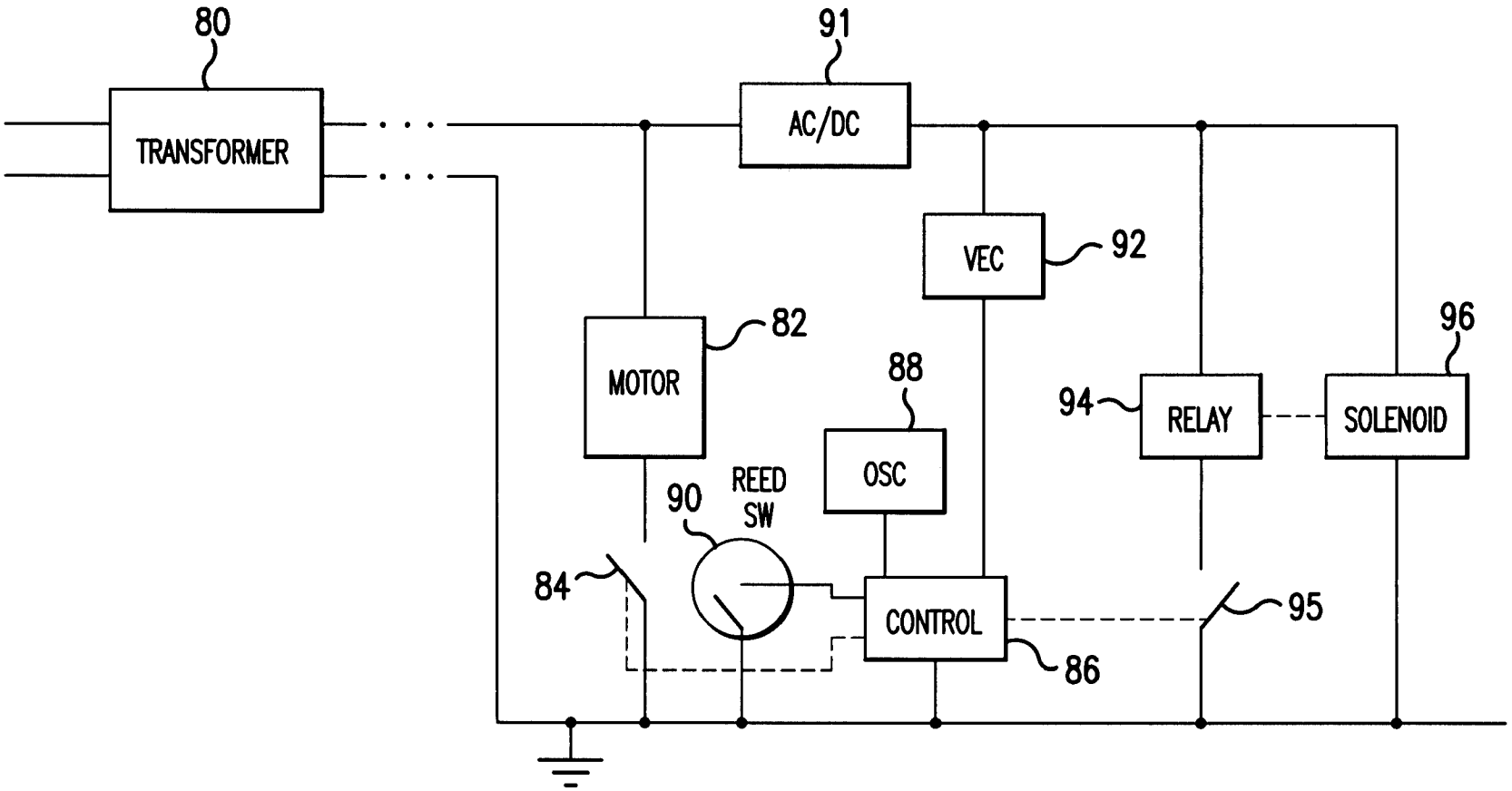
FIG. 7 is a circuit diagram of the electrical portion of the present invention.

FIG. 7 is a circuit diagram showing electrical connections of the unit. Incoming house current is received by transformer 80 which steps down the voltage to 24 volts. It may also contain an on/off switch, circuit breaker, and other safety devices. Typically, this unit will be self-contained and sit on the outside of the pool so that only 24 volt power is applied to the water. The output of this transformer is connected by a long wire, indicated by the dotted lines to the cleaning unit. The wire may be made with a buoyant outer material so that the wire floats on the water, and does not pull against the unit nor lie on the floor of the pool and thus get in the way of the unit.

The motor 82 is connected to this 24 volt power and is turned on and off by a switch 84. Although a mechanical switch is shown, in reality, an electronic switch is preferable and if desired, could be a switch which could even control the speed of the motor. This switch is controlled by controller 86 which controls all of the operation of the device. The controller receives inputs from an oscillator 88 and reed switch 90. The reed switch is connected to at least one of the wheels to indicate whether the device is moving or not. The oscillator provides a clock signal which is provided to various registers in the controller to determine periods of time. A unit 91 converts the 24 volt AC signal to a DC signal using diodes or other devices to provide a DC source of power for those parts which require DC current. This power is provided to unit 92 which steps down the voltage of the DC current to the standard voltage applied to the circuit board such as three volts. This provides the power to the chips and other components of the circuit board. Relay 94 also receives the DC current and is turned on and off by switch 95 under the control of the controller 86. This switch likewise can be an electronic switch rather than a mechanical switch. When the controller closes the switch, relay 94 fires and switches the power on in solenoid 96. This solenoid is used to control the diverter valve, as described above.

When the cleaning unit is placed on the bottom of the swimming pool and power is applied, the controller closes switch 84 and causes the motor to operate which pumps water out nozzle 16, causing the unit to move across the floor of the pool. As the unit moves, all four wheels also move, causing reed switch 90 to periodically open and close giving an indication to the controller that the device is moving. When the cleaning unit impacts a wall and stops moving, signals from the reed switch stop, which is sensed by the controller. When this happens, the controller closes switch 95 which causes relay 94 to activate solenoid 96. This causes the diverter valve to change positions and send high powered water from the pump through the other nozzle causing the unit to move in the opposite direction. Due to the pivoting action of the front axle, when the unit changes direction, the axle will pivot slightly so that the path it takes in going in the opposite direction will be slightly different from that in the forward direction. As a result, the cleaning device continually changes paths as it moves around the pool. Given enough time, the random path will cover essentially all of the bottom of the pool so that the entire pool bottom will be cleaned in the process. Empiricly, three hours is sufficient time to clean most pools and the individual owner can determine by observation if a lesser amount of time is desirable.

The controller includes at least three timers to help control the operation of the device. A first timer is merely set for the time of operation of the entire device. Thus, this timer will indicate when three hours has passed so that the controller will know that it is possible to shut down the operation of the device at that time.

Other timers may be involved to determine any problems in the cleaning unit. For example, if the cleaning unit will normally traverse the pool in thirty seconds, and hence change direction at that time, a timer may be set for a larger amount of time, such as sixty seconds, and determine if the wheels have stopped during that time period. If the wheels have not stopped in sixty seconds, this may indicate a situation where the unit has gotten hung up on an object, such as a drain in the bottom of the pool. If the particular shape of the drain or other obstacle catches a wheel, it is possible that the unit will continue to move in a tight circle so that the wheels continue to move while the cleaning device is basically trapped. Without this timer, the controller would not realize that anything was wrong.

Another timer of much shorter duration, such as three seconds can also be implemented to determine if the wheel stops very quickly after turning on. This would be the situation where the unit gets trapped against a ladder or in a corner and continually reverses direction, but follows a very short closed path. This helps the controller to determine that this situation exists.

Figure 8:
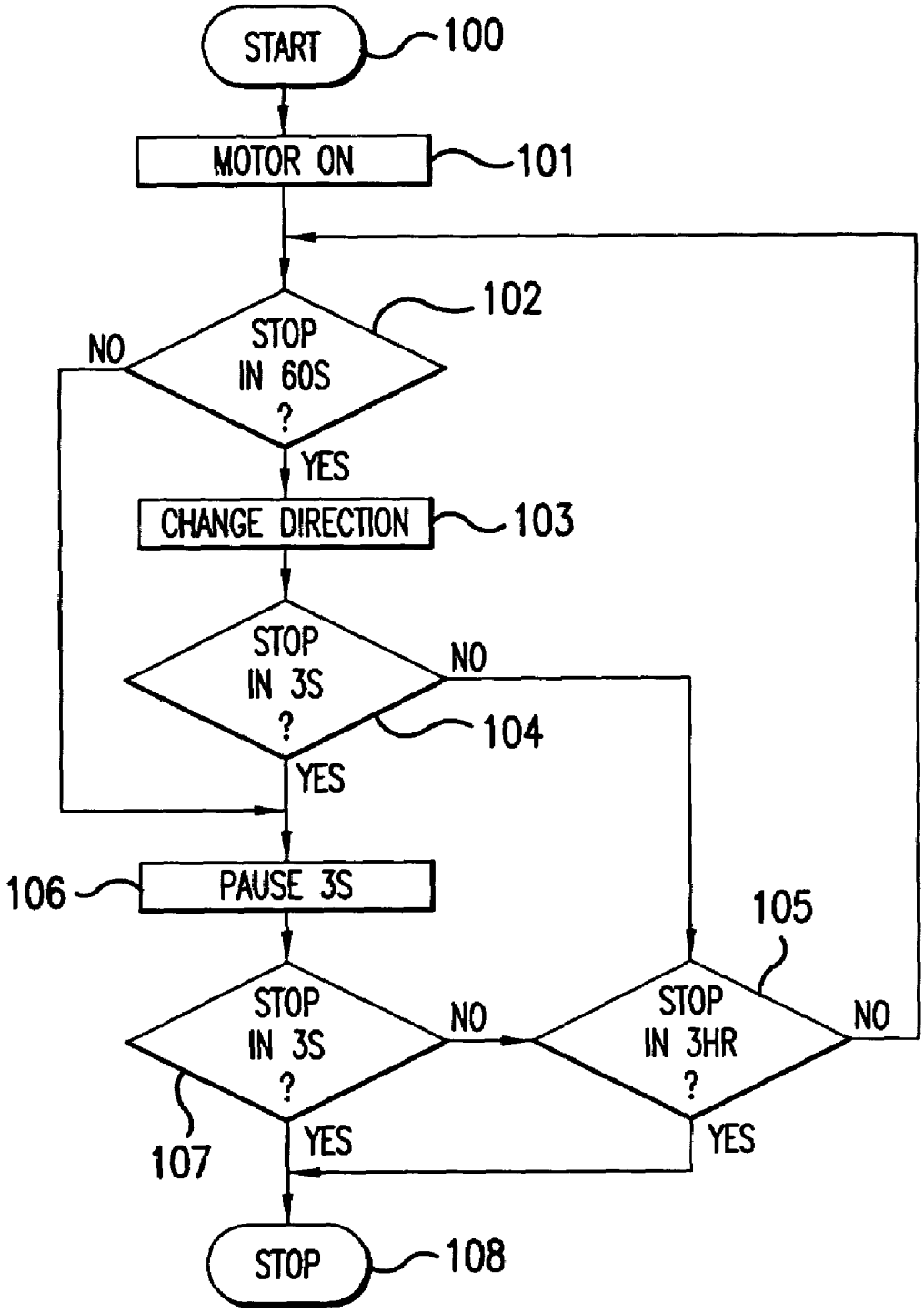
FIG. 8 is a flow chart showing the operation of the present invention.

FIG. 8 is a flow chart indicating the operation of the unit, especially in regard to the various timers. In step 100, the operation begins, the registers are initialized and the controller is set up and power starts to flow. In step 101, the motor is turned on and the unit starts the cleaning operation. In step 102, if the controller senses that the wheels have stopped moving within sixty seconds, normal operation is determined and if the answer is yes, the direction of the movement is changed using solenoid 96 and the diverter valve as indicated in step 103. The three second timer determines in step 104 whether wheels have stopped moving within three seconds of the change. If it has not, this indicates normal operation and the device continues to operate normally unless the three hour limit has been reached as indicated in step 105. If the limit is not reached, normal operation returns to step 102. If the limit has been reached, the device will stop as indicated in step 108.

If the result of step 104 indicates that the device stopped within three seconds of changing direction, the motor is paused as indicated in step 106 and direction changed again. If the wheel stops again in three seconds as indicated in step 107, the device is stopped. If it has not stopped within three seconds after the pause, it is assumed that normal operation has resumed and the total three hour time limit is considered.

If the answer to step 102 is that the device did not stop within sixty seconds, this indicates that the cleaning unit may have become hung up and the motor is paused and reversed in the same manner in step 106 and 107 to determine if it can be recovered. If not, the unit is stopped.

Accordingly, the controller can determine if the device is moving normally and changing direction every sixty seconds or less, and determine if the unit is trapped and reversing every three seconds or less. The controller can also include other problem determining features if desired. Although not shown, the controller can activate some visual or auditory signal to indicate to the owner that proper operation has ceased due to a problem.

Numerous additional modifications and variations of the present invention are possible in light of the above teachings. It is therefore to be understood that within the scope of the appended claims, the invention may be practiced otherwise as specifically described herein.

What is claimed is:

1. A swimming pool cleaner, comprising:

a hollow body mounted on wheels;

a pump for moving water from the pool into the hollow body and outwardly again;

a filter for removing dirt from water pumped into said body;

inwardly swinging doors mounted on the bottom of said body for allowing water to enter;

outwardly swinging spring loaded doors constructed of a rigid material and mounted on said hollow body for allowing water that has been filtered to include dirt removed from the swimming pool to exit when the swimming pool cleaner is removed from the swimming pool by the weight of the water acting against the outwardly swinging spring loaded doors to open the outwardly swinging spring loaded doors when the swimming pool cleaner is removed from the swimming pool.

2. The swimming pool cleaner according to claim 1, wherein said outwardly swinging spring loaded doors are mounted on sides of the hollow body.

3. The swimming pool cleaner according to claim 1, wherein said inwardly swinging doors are spring loaded.

4. The swimming pool cleaner according to claim 3, wherein spring loaded inwardly swinging doors are a check valve for preventing water contained within the hollow body to exit from the inwardly swinging doors when the pool cleaner is removed from the swimming pool.

5. The swimming pool cleaner according to claim 1, wherein the inwardly swinging doors permit a suction from the pump to open the inwardly swinging doors during use within the pool to permit a flow of water through the filter for filtering dirt therefrom.

6. The swimming pool cleaner according to claim 1, and further including handles mounted on side portions of the hollow body for grasping the pool cleaner.

7. The swimming pool cleaner according to claim 6, wherein the outwardly swinging doors are mounted adjacent to the handles.

8. The swimming pool cleaner according to claim 1, wherein when the swimming pool cleaner is disposed in the swimming pool, the weight of the water within the swimming pool and the springs maintain the outwardly swinging spring loaded doors in a closed position.

9. The swimming pool cleaner according to claim 8, wherein when the swimming pool cleaner is removed from the swimming pool, the outwardly swinging spring loaded doors act against a spring force maintaining the outwardly swinging spring loaded doors in a closed position for permitting water that has been filtered to include dirt to be exit from the swimming pool cleaner.

10. A swimming pool cleaner, comprising:

a hollow body mounted on wheels;

a pump for moving water from the pool into the hollow body and outwardly again;

a filter for removing dirt from water pumped into said body;

at least one inwardly swinging door mounted on the bottom of said hollow body for allowing water to enter into a space formed within the hollow body;

at least one outwardly swinging spring loaded door constructed of a rigid material and being mounted on said hollow body for allowing water that has been filtered to include dirt removed from the swimming pool to exit when the swimming pool cleaner is removed from the swimming pool by the weight of the water within the hollow body acting against the at least one outwardly swinging spring loaded door to open the at least one outwardly swinging spring loaded door when the swimming pool cleaner is removed from the swimming pool.

11. The swimming pool cleaner according to claim 10, wherein said at least one outwardly swinging spring loaded door is mounted on a side of the hollow body.

12. The swimming pool cleaner according to claim 11, wherein said at least one inwardly swinging door is spring loaded.

13. The swimming pool cleaner according to claim 12, wherein the at least one spring loaded inwardly swinging door is a check valve for preventing water contained within the hollow body to exit from the inwardly swinging doors when the swimming pool cleaner is removed from the swimming pool.

14. The swimming pool cleaner according to claim 10, wherein the at least one inwardly swinging door permit a suction from the pump to open the at least one inwardly swinging door during use within the pool to permit a flow of water through the filter for filtering dirt therefrom.

15. The swimming pool cleaner according to claim 10, and further including handles mounted on side portions of the hollow body for grasping the swimming pool cleaner.

16. The swimming pool cleaner according to claim 15, wherein the at least one outwardly swinging door is mounted adjacent to the handles.

17. The swimming pool cleaner according to claim 10, wherein when the swimming pool cleaner is disposed in the swimming pool, the weight of the water within the swimming pool and the springs maintain the at least one outwardly swinging spring loaded door in a closed position.

18. The swimming pool cleaner according to claim 17, wherein when the swimming pool cleaner is removed from the swimming pool, the at least one outwardly swinging spring loaded door acts against a spring force maintaining the outwardly swinging spring loaded doors in a closed position for permitting water that has been filtered to include dirt to exit from the swimming pool cleaner.

* * * * *